United States Patent [19]

Bailey et al.

[11] 3,991,835

[45] Nov. 16, 1976

[54] PNEUMATIC ROCK DRILL WITH PERIPHERAL PISTON CLEARANCE SPACE

[75] Inventors: Edward A. Bailey, Newport; Walter D. Fish, Claremont, both of N.H.

[73] Assignee: Joy Manufacturing Company, Pittsburgh, Pa.

[22] Filed: Dec. 11, 1974

[21] Appl. No.: 531,564

Related U.S. Application Data

[63] Continuation of Ser. No. 386,457, Aug. 7, 1973, abandoned.

[52] U.S. Cl. ..... 173/134; 91/232; 92/162 R

[51] Int. Cl.[2] ..... E21C 3/24

[58] Field of Search ..... 92/162, 165, 172, 162 R; 173/134–138, 78; 91/232

[56] References Cited

UNITED STATES PATENTS

| | | | |
|---|---|---|---|
| 2,041,690 | 5/1936 | Baumeister et al | 173/138 X |
| 2,101,159 | 12/1937 | Stevens | 92/162 X |
| 2,694,383 | 11/1954 | Larcen | 92/172 X |
| 2,878,990 | 3/1959 | Zurcher | 92/162 X |
| 2,970,546 | 2/1961 | White | 92/162 R |
| 3,319,534 | 5/1967 | Boonshaft | 92/162 R |
| 3,666,024 | 5/1972 | Beaumont | 173/134 X |

FOREIGN PATENTS OR APPLICATIONS

| | | | |
|---|---|---|---|
| 137,070 | 7/1960 | U.S.S.R. | 91/232 |

*Primary Examiner*—Ernest R. Purser

[57] ABSTRACT

A fluid operated reciprocating piston rock drill wherein the piston has a stem portion closely slidably received in a guide bushing and the cylinder of the rock drill provides clearance space around the head of the piston.

5 Claims, 1 Drawing Figure

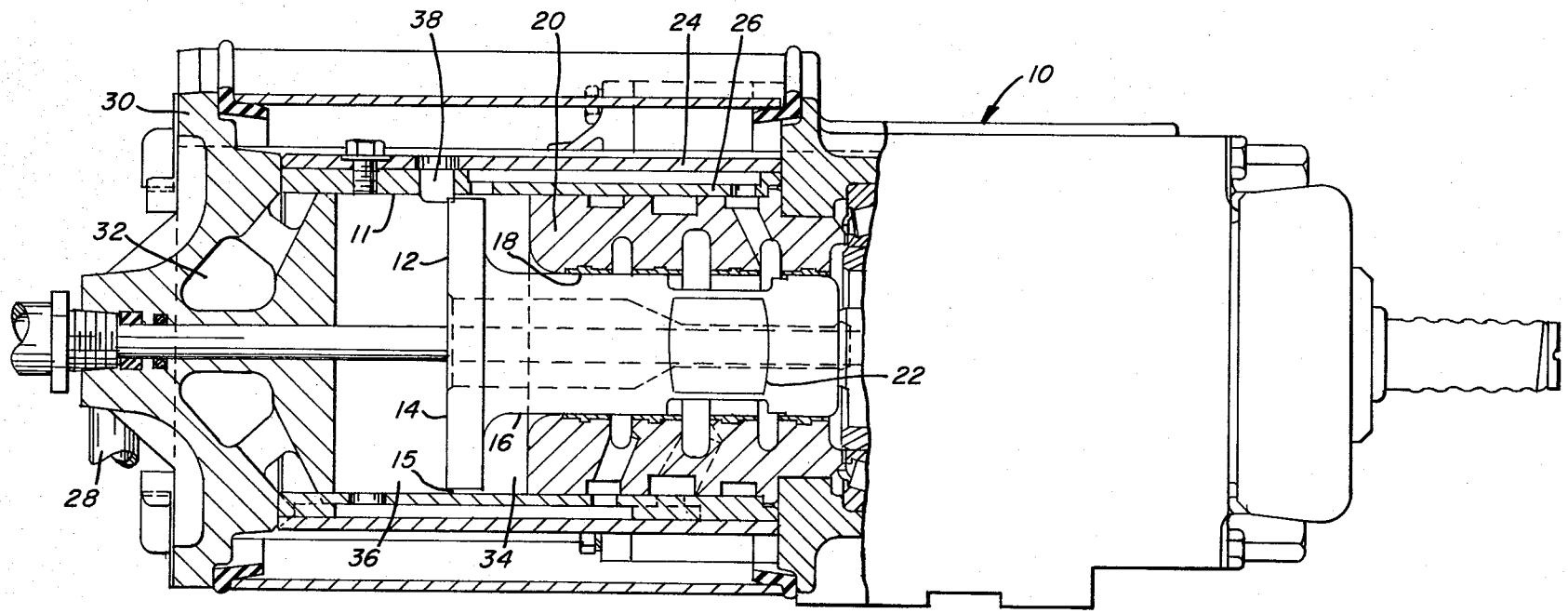
10
22
26
24
20
18
16
34
38
12
14
15
11
36
30
32
28

PNEUMATIC ROCK DRILL WITH PERIPHERAL PISTON CLEARANCE SPACE

This is a continuation of application Ser. No. 386,457, filed Aug. 7, 1973, and now abandoned.

In the field of rock drill manufacture it has been well known to provide a reciprocating piston with a stem portion having passages therein to provide "valveless" operation by using the stem portion of the piston in lieu of separate valving. In this type of stem piston it has been usual to provide a piston head portion thick enough in the axial direction to provide suitable bearing surfaces against the cylinder walls to absorb transverse loading on the piston while the stem portion was relatively loosely received within a buffer bushing with the clearance of the stem portion within the buffer bushing being controlled by the desire to minimize leakage of air in the valving operation.

Such prior art devices have operated satisfactorily but the present inventors felt that an improvement would be possible by making the piston lighter with a resultant increased reciprocating frequency in normal operation. The main weight of the piston being in the head portion because of its relatively large diameter the present inventors decided to reduce the thickness of the head portion (in the axial direction) below that of prior art machines relative to the piston head diameter which immediately called into question the amount of bearing area on the side of the piston which would be available for taking transverse loading on the piston. The present invention eliminates the need for any particular amount of bearing area on the side of the piston by eliminating the side loading on the piston head in that the stem portion is more closely fitted to the buffer bushing which now becomes a guide bushing for the piston and the piston head itself is dimensioned to provide clearance between itself and the cylinder at all times. It is of course possible that when the guide bushing becomes worn or under other conditions of use the piston may touch some place within the cylinder at various times without departing from the principles of this invention.

Prior art machines of the various manufacturers have used piston head thickness to piston diameter ratios on the order of 0.40 to 0.48 with the smallest ratio presently known to the inventors being that of a piston such as that shown in U.S. Pat. No. 3,666,024 in the vicinity of 0.25 and a similar drill built by applicants' assignee having a ratio of approximately 0.22. In distinction to such values the piston thickness to diameter ratio of the present inventon provides values in the range from 0.17 to about 0.02 or slightly below according to the desires and judgment of the particular designer.

It is therefore an object of this invention to provide a new and improved reciprocating piston rock drill wherein transverse loading on the piston is absorbed by a stem portion of the piston cooperating with a guide bushing therefor.

The advantages resident in the apparatus of this invention compared to prior art structures reside in a reduced head thickness reducing the weight of the piston resulting in increased frequency of reciprocation which in turn adds to the rate of energy input to the drill steel and therethrough to the rock face for an increased cutting rate (an increase from 2400 per minute to 3000 per minute in a given design. In this design the force of blow is maintained at a level which can be tolerated by the steel system under the drill and is generally equal in both new and old machines. The force of blow (FOB) is generally related to the following formula: FOB = PAL where P = effective pressure on the piston, A = the effective area of the drilling side of the piston and L = the length of stroke. A change of mass does not appreciably affect the force of blow as the above formula points out. The speed of the piston cycle is governed by F = Ma in which F = the force on the piston, M = the mass of the piston and $a$ = its acceleration. The force on the piston has the following relationship: F = PA where F = force on the piston, P = the pressure on the piston and A = the area of the piston, and since these parameters have been kept equal in the old and new designs, then F is fixed. Therefore, when M is reduced, a (acceleration) increases. This increase in acceleration allows the piston to travel through the cycle oftener and the frequency is increased without an appreciable change in force of blow.

It is further to be realized that a reduction in piston head thickness allows a reduction in cylinder length which may be taken advantage of in reduction of the total length of the drill which in turn allows a shorter guide frame for a given feed length all of which are of advantage in reducing weight, bulk and overall dimensions of the apparatus.

These and other objects and advantages of this invention will become more readily apparent upon consideration of the following description and drawings in which:

The single FIGURE is a partially sectioned side elevational view of a rock drill constructed according to the principles of this invention.

In the FIGURE there is shown a rock drill of the valveless type generally indicated at 10 very similar in construction and operation to that shown and described in the above cited U.S. Pat. No. 3,666,024 to which reference may be had for description of the structure and the operation of such a rock drill. The rock drill 10 comprises a cylindrical surface 11 within which is reciprocable a stem type piston 12 having a head portion 14 closely received within the cylindrical surface 11 but dimensioned to provide a peripheral clearance as at 15 between the head portion 14 and the cylindrical surface 11 which clearance is maintained by a stem portion 16 of the piston 12 closely slidably received within a hollow cylindrical guide bushing 18 of aluminum or bronze or other material having a suitably low coefficient of friction in contact with the material of the piston 12. The bushing 18 is mounted in and supported by the buffer ring 20 of the usual type mounted in the forward end portion of the cylindrical surface 11 wherein the buffer ring 20 has the usual passages therein communicating by way of grooves 22 in the piston stem 16 and passageways formed between the cylinder body 24 and a cylinder liner 26 to provide compressed air or other power fluid alternately to the opposite faces of the piston head portion 14 in a well known manner for the operation of a valveless rock drill. To provide for such operation compressed air or other pressure fluid is provided through a flexible fluid conductor or hose 28 connected to a back head 30 of the rock drill 10 and communicating therethrough by passages partly shown at 32 with the aforementioned buffer ring passageways and ultimately with the cylinder portions on opposite sides of the piston head portion 14.

In the position of the piston shown in the figure compressed air supplied through the conductor 28 and suitable passageways will be connected by piston passageways 22 to the portion of the cylindrical surface 11 to the right of the piston as seen in the figure hereinafter named the retract chamber 34 for the purpose of pushing the piston to the left. When the piston has traveled to the left a sufficient distance the piston passageways 22 will connect the power fluid to the portion of the cylinder 11 to the left of the piston head (as seen in the figure) hereinafter the impact chamber 36 with the retract chamber 34 at the same time being connected to exhaust through ports 38 all in a well known manner. It is to be noted that although the piston 12 is shown as having clearance 15 with relation to the cylinder 11 this clearance is desirable only a few thousandths of an inch with the result that the narrowness of the passageway 15 provides what is called space packing to prevent any significant amount of leakage of the compressed air from the chamber 34 to the chamber 36 and vice versa for the impact portion of the strokes.

As shown in the figure the diameter of the piston head portion (nominally 6½ inches) is related to the thickness of the head portion 14 (nominally ¾ inches) in the ratio of head thickness to head diameter of approximately 0.12. In comparison to prior art ratios of the order of 0.25 to 0.48, the present invention provides a much lighter piston and uses the stem portion in the bushing 18 to provide guidance and accept the transverse piston loading in a manner very superior to the prior art piston loading on the edge of the piston head with the additional advantage of providing selection of material for the cylinder body liner 26 on the basis of the needed strength and machinability with no necessity for providing low friction characteristics relative to the piston head 14. Of course the bushing 18 can be made of any material of suitable low friction characteristics relative to the piston stem 16. It is also to be noted that the bushing 18 provides a much longer bearing surface than would ever be available with the prior art stem type piston which depended on piston head side surface for bearing area.

Thus, the present invention provides a device of better wearing qualities, lighter piston with higher frequency giving faster cutting rate, shorter body length for a given stroke and lighter weight because of reduced body length all arising from the transferrance of transverse piston loading from the head portion of the piston to the stem portion thereof allowing a lower ratio of piston head thickness to head diameter than ever used before in such structures.

A preferred embodiment of the principles of this invention having been described and illustrated it is to be realized that variations are possible without departing from the scope of such principles. It is, therefore, respectfully requested that this invention be interpreted as broadly as possible, limited only by the scope of the appended claims.

What is claimed is:

1. A pneumatic rock drill assembly comprising: a rock drill body member adapted to carry a striking bar; a bore within said body member; a stepped piston member coaxially received and reciprocable within said bore and adapted to impact on such a striking bar; said piston member including a stem portion received within a reduced diameter portion of said bore and a head portion received within a larger diameter portion of said bore; said head portion having the exterior axial extent thereof of a diameter smaller than the diameter of said larger diameter portion to define a continuous open peripheral space between said head portion and said larger diameter portion of said bore; said stem portion being closely slidably received within said reduced diameter portion to maintain said peripheral space throughout the reciprocation of said piston member; and passageway means in at least one of said members operable to direct pneumatic pressure fluid alternately to said opposed faces to reciprocate said piston member.

2. A rock drill assembly as specified in claim 1 wherein said exterior axial extent defines the thickness of said head portion and the ratio of said thickness of said head portion to the diameter of said head portion is in the range between 0.17 to 1 and about 0.02 to 1.

3. A rock drill assembly as specified in claim 2 wherein the frequency of reciprocation of said piston is at least 3000 cycles per minute when pressure fluid is being supplied to said drill under pressure in the range of about 95 to 125 pounds per square inch.

4. A rock drill assembly as specified in claim 3 wherein said frequency is within the range of 3000 to 5000 cycles per minute.

5. A rock drill assembly as specified in claim 3 wherein said frequency is about 3000 cycles per minute.

* * * * *